US005125130A

United States Patent [19]

Stanish

[11] Patent Number: 5,125,130

[45] Date of Patent: Jun. 30, 1992

[54] ERGONOMIC HANDLE FOR TOOLS AND SPORTING EQUIPMENT

[76] Inventor: Walter F. Stanish, 118 Rochelle Ave., Philadelphia, Pa. 19128

[21] Appl. No.: 551,329

[22] Filed: Jul. 12, 1990

[51] Int. Cl.[5] ..... A47B 95/02

[52] U.S. Cl. ..... 16/110 R; 16/111 R; 273/81.3; 294/57

[58] Field of Search ..... 16/110 R, 111 R, DIG. 12, 16/DIG. 19; 273/81.3, 77 R, 73 J; 294/57, 58

[56] References Cited

U.S. PATENT DOCUMENTS

| | | | |
|---|---|---|---|
| 1,979,174 | 10/1934 | Robertson | 273/81.3 |
| 4,038,719 | 4/1977 | Bennett | 16/110 R |
| 4,109,339 | 8/1978 | Dietrich | 16/DIG. 12 |
| 4,183,528 | 4/1980 | An | 273/75 |
| 4,269,412 | 2/1981 | Hughes | 273/81.3 |
| 4,454,623 | 6/1984 | O'Halloran | 15/167 R |
| 4,625,965 | 12/1986 | Mullins | 273/81.3 |
| 4,704,758 | 11/1987 | Hoffman | 294/57 |
| 4,852,877 | 8/1989 | Scalf | 273/77 R |
| 4,934,024 | 6/1990 | Sexton | 16/DIG. 12 |
| 4,985,961 | 1/1991 | Kegley | 16/110 R |
| 5,060,343 | 10/1991 | Nisenbaum | 16/111 R |

*Primary Examiner*—Richard K. Seidel
*Assistant Examiner*—Patty E. Hong

[57] ABSTRACT

Disclosed herein is an ergonomic handle for tools and sporting equipment which reduces discomfort and increases control. The handle comprises an elongated member equipped with a two-membered gripping portion at one end whose two members are disposed at compound angles from the longitudinal axis of the elongated member, corresponding to the natural angles of hand, wrist, and forearm in a pointing posture.

7 Claims, 5 Drawing Sheets

ERGONOMIC HANDLE FOR TOOLS AND SPORTING EQUIPMENT

The present invention relates to handles and more particularly to handles for tools and sporting equipment.

BACKGROUND OF INVENTION

Recently, several products have been introduced claiming the ergonomic benefits of angled handles. Such bent handles add leverage and reduce joint stress through enhanced alignment of tool shaft with user's arm. While user comments have been encouraging, sales have been less than impressive, suggesting a less than sufficient ergonomic advantage to the public at large. Still, there is a growing concern over repetitive motion injuries in industry, an ever present need to modernize production and introduce ergonomic advantages to new technologies, as well as an interest in the marketing value of new designs. Each of these factors add to the demand for more satisfying and effective tool handles. Thus, the generative "ergonomic" challenge persists—to make handles that are safer and easier to use, while being attractive and cost competitive.

One of the basic goals of ergonomic tool design is to determine a handle shape which can reduce discomfort and improve performance, through proper fit. Therefore, comprehensible criteria for handle specifications are sought, to translate the subjective construct of "proper fit" into relatively more clear-cut engineering terms. In sum, this tool handle innovation represents a simple rule for manufacture, in order to create an "ergonomic" tool handle. The premise of this invention is that, tool handles, with a certain angular configuration, will substantially reduce problems of user discomfort, and increase tool use effectiveness, at a worthwhile cost of manufacture.

The handle, in this invention, is specially designed to acknowledge the natural angles between the gripping portion of the hand, the axis of the forearm, and their alignment with the torso, during use. This tool handle configuration tries to conform with a certain anatomical posture, emphasizing a relatively straight, balanced, and relaxed alignment of the wrist, arm and torso. This certain posture describes a pointing-type hand grip, a straight wrist, and a partially bent elbow more or less close to a generally erect torso. The maintenance of this posture improves the likelihood of tool control and comfort during work performance. The handle, in this invention, allows the user to execute work activities, from this certain posture, more often than conventional prior art handles. The resultant benefits from such an advantage are substantial.

PRIOR ART OF INVENTION

In the prior art, Bennett, 1977, has explained the importance of maintaining alignment of body parts (specifically the wrist joint), to reduce localized joint stress and muscular effort. Numerous examples of simple bends in handles acknowledge this fact, but are less than sufficient for a variety of reasons. A simple angle of 19 degrees across the palm of the hand, as specified by Bennett, better fits the wrists, but does not clearly accommodate the closing dynamics of the palm and fingers. The orientation of this grip axis on the palm of the hand, neither allows enough space for encroaching motions of the thumb base, nor brings the axis of the handle close enough to the relatively small grasping range of the ring of closure, formed by the smaller fingers of the hand against the outer edge of the palm. Also, while a simple, angled handle may better align the wrist within one plane, it may not accommodate true alignment from other perspectives. Thus, the simple, uni-planar angle still allows a significant number of potentially stressful wrist postures.

To further accommodate the depth aspects of the hand, another feature of grip design should be recognized, namely, orientation of conforming grip planes. The use of conforming planar surfaces, on a tool handle grip, relates to the problem of providing a larger area of interface for transferring forces between the hand and tool. Any accompanying facets, or edges, of such planes can also provide resistance to twisting and slipping forces, as well as additional sensory feedback for control decisions. But, they also increase friction effects and can reduce specific areas of needed interface.

The selection of varying cross-section tool handle shapes (whether circular, ovate, square, or polygonal) relates to such dynamics. Each type of cross-section offers different performance characteristics. A tool handle with a circular cross-section allows a uniform rotation of the gripping hand to adjust to a comfortable gripping posture, for varying tool orientations. The ovate cross-section is a close approximation of the shape of the closed hand. The polygonal cross-section offers both flat planes and facets. Furthermore, certain applications employ supplemental cushion grips of varying textures and shapes, to overcome the usual interfacing problems, as well as excessive pressure, vibration, or slippage demands.

To address such particular hand closure issues, An,80, suggests a two-part grip with a displacement of the grip axis, conforming to the space of a crease in the palm. Purportedly, this modification accommodates a functional split in hand gripping dynamics. Specifically, the An, 80 grip conforms mainly to a grip posture, described by a pointing of the index finger and a grasping of remaining three fingers. For certain applications, such features are deemed worthwhile, as evidenced by numerous trigger devices, as well as custom-fitted, or conforming grip designs in the prior art. But, the transition area between the two-parts of the An, 80 grip is problematic. The additional edges can add discomforting localized friction. More detrimentally, this complicated transition decreases options both for alternate gripping postures and appropriate tool applications.

Huges, 81 presents a contoured golf club grip whose angularly disposed upper and lower portions purport to align with both gripping hands. But, an indicated upward angle for the lower portion contradicts the principle of a wrist alignment recommended by Bennett, 77. Nonetheless, the relatively small angles specified are insufficient to accommodate either the downward wrist-aligning disposition, or other aspects of the grip, as mentioned in An, 80.

The prior art presents the strengths and weaknesses of angles and shapes of grips. All handle and grip designs are a compromise of such desirable and detrimental features, balanced against the particular application. Such considerations often lead to complex and confusing specifications of increasing or decreasing tapers, as well as flattened planes on conforming shape grips. Clearly, the overall situation begs for simplification. And, neither a simple angle nor a disjoint axis configuration make a serious attempt to address either anatomical laterality or dual-handed usage. The handle of this invention offers a relatively simple guideline to make such choices.

DESCRIPTION OF INVENTION

As a first step toward minimizing such difficulties, the handle of this invention specifies a larger angle of 26 to 34 degrees for the basic plane of the gripping portion of the handle. Within the palm of the hand itself, this larger angle better accommodates a freer motion of the thumb, a more secure, comforting grasp by the smaller two fingers, and a more dexterous, controlling contact with the base of the two forefingers. More critically, the handle of this invention specifies an offsetting angle of 26 to 34 degrees, which accommodates several natural features of the hand and forearm, to achieve a relaxed, balanced, overall straight posture. Firstly, this compound angle corresponds to the pointing posture of the hand itself. Secondly, this compound angle aligns with, and provides support of the forearm's ulna end, at a more or less horizontal position, during pressing, pointing, and lifting hand postures. Thirdly, this angle allows space for the extended palm's natural tendency to sag with its own weight and curve downward on the little finger edge.

For many tool grips, one of the major determinants of control and comfort, is the area of closure defined by the two smaller fingers of the hand against the palm, the clasping zone. For the conforming planes of such grips, a forward rotation angle of 26 to 34 degrees is specified to correspond with the downward curl of the relaxed palm, and conform with the surface planes of the palm and smaller finger pads in a clasped position. This additional alignment of grip planes augments the clasping function of the hand's smaller fingers, in accordance with the overall goal of maintaining the earlier described "straight" anatomical posture. Also, by specifically fitting a handle feature to the physiological function of simply holding the tool with the smaller two fingers of the hand, the movement and control of the larger two, remaining forefingers is enhanced. A secure, comfortable, clasping hold by the small fingers allows a more relaxed, pointing, directing, and controlling hold by the larger, index and middle fingers.

Additionally, the offset orientation of the gripping portions of the handle of this invention both defines and accommodates laterality in human performance. Very often, left-handed people complain both, about being forced to use products which are supposedly designed for right-handed use, and, the lack of more appropriately designed, left-handed handles. This specialization can be a major improvement for certain select applications where the maximum strength and control abilities of the dominant hand are required.

To this point, the referred to angular disposition for the above gripping portion, has been described, mostly in terms of single-handed us, by the dominant hand. More importantly, a similar, secondary gripping portion is specified as an attachment to, or extension from the end of the primary gripping portion of the handle. The angles for this secondary gripping portion remain the same, but with the opposite direction, reflecting the laterality of the user. This secondary portion is thereby better aligned with the axis of the forearm of the opposite, or supporting hand of the user. Thus, unlike prior art, this two-membered gripping portion provides the benefits of reduced joint stress and improved effectiveness to each hand separately, and both hands together. This accommodation for laterality and duality has exceptional benefits for tool applications requiring precise control and powerful coordination as found in swinging and striking devices (e.g. tennis rackets, golf clubs, sledgehammers, paint rollers.)

Another significant consequence of this secondary gripping portion offset relates to bodily interference, with larger tool applications. The tail section of the gripping portion of the tool handle is easily within reach, but not protruding directly into, and having motions interfering with, the torso. This feature provides the user more, and better, two-handed leveraging positions. Additionally, by allowing whole body adjustments to maintain erect postures during work activities, this orientation minimizes potentially injurious, excessive torso flexions. While redirecting some of the leveraging movement of the rearmost tool handle section away from the torso, this angular disposition also presents a substantial surface for applying additional pressure with the user's torso. This allows the user to employ overall body mass (of the torso) to supplement the muscular exertion of the limbs, and thereby substantially reducing localized user stress and fatigue. Though the described, prior art angle partially augments wrist and elbow action, such benefits can not be claimed to substantially extend further to other joints, or to the torso itself.

A less obvious, but quite noteworthy benefit of the relative complexity of these oriented members is that a variety of gripping postures are possible. The shifting of hand location, grip orientations, and overall balance of exertion is a significant aspect of tool design. Adjustments of grip and bodily posture help to prevent static fatigue. Also, injuries due to the cumulative effects of the repetition of similar motions are exaggerated by fixed or limited posture. Thus, the variety of anatomical posture options substantially improve the possibility of distributing, and thereby mitigating, cumulative stress disorder effects for the user.

One immediately apparent consequence of an offset tool handle is the variety of options for orientations of the tool head onto the tool shaft. A significant feature and major determinant in the selection of applications for this handle invention is that of improved tool head visibility. In consideration of the overall body posture, it is evident that in some straight, conventional tool handles, the visibility of the tool head is obstructed by the tool itself. The offset handle configuration of this invention orients the hand and tool handle out of the line of sight of the tool head, while maintaining a natural, pointing posture for maximum control, in many cases. This combination of clear tool head visibility and strong tool handle grip substantially improves overall tool control by placing the tool head closer to the subjective target.

The scope of applications for this handle invention is extraordinary, while the resulting effects on the user, in each of these applications are surprising. For even the simplest application, a relatively small cost is added to manufacture, for a substantial improvement in performance. Where more elaborate, and costly customized forms are called for, the inclusion of these design principles will offer profound opportunities within almost every aspect of product development.

SUMMARY OF THE INVENTION

The handle of this invention comprises a neck elongated member and a two-membered gripping portion.

The neck elongated member is held horizontally and perpendicular to the plane formed by the front of the torso as seen from above. The tool head, located at one end of the neck elongated member, with the gripping portion at the other end, is thereby oriented directly in front of the user.

The two-membered gripping portion is disposed at an angle of approximately 26 to 34 degrees to the longitudinal axis of the neck. The angle between the neck and the gripping portion corresponds to the angles of wrists' flexion and extension, when the forearm is substantially horizontal, with a more or less erect torso and the hand aligned, in a pointing gesture, with the index finger topmost and the palm and wrist joint relaxed.

The two-membered gripping portion comprises two elongated members, a front portion and a rear portion, joined at a bend of between 112 and 124 degrees. The offsetting angles of each elongated member of the two-membered gripping portion correspond to the rotation of the palm of the hands into a pointing posture at the wrist joint, about the axes of the forearms. The first elongated member, or front portion of the two-membered gripping portion is disposed at an acute angle of approximately 26 to 34 degrees outward, toward the dominant hand side. The second elongated member, or rear portion, of the two-membered gripping portion is disposed at a similar acute, but opposing angle of approximately 26 to 34 degrees in ward, toward the supporting hand side.

The handle of Applicant's invention has an essentially circular cross-section and is optionally covered with essentially ovate cross-section cushion grips, located at the mid-sections of the front and rear elongated members of the two-membered gripping portion. The major axes of the ovate cross-section cushion grips are rotated forward, from a side view perspective, toward the implement, at an angle of approximately 26 to 34 degrees. This rotation angle corresponds with the natural sagging downward of the outer edge of the palm of the hand.

Such a combination of compound, offsetting and, where applied, rotated conforming plane angles more fully prevents excessive wrist, and other joint flexions, both in static pressing or lifting, and dynamic swinging actions. The resultant, straight overall skeletal alignment, allows a more direct transfer of body mass forces into tool handle surface. This configuration reduces specific muscular effort and discomfort and increases overall power, while offering a variety of safe, cumulative stress reducing, tool holding postures. Additionally, the accommodation of laterality significantly enhances work performance, for both single and dual handed usage.

OBJECTIVES

In totality, the net result of this handle bending configuration is that, the user is able to grip an implement by the handle, with his hands, wrists, and forearms in relaxed but aligned postures, so that less muscular energy is expended to hold the implement, while encouraging a more coordinated, distributed muscular effort by the whole body, from a comfortable variety of gripping postures, while extending a tool head in a more visible and controllable manner.

Consequently, it is an objective of this invention a produce a handle for tools and sporting equipment that is specifically designed to be ergonomically efficient.

It is yet another objective of this invention to define a handle that minimizes excessive bending of the wrist and other joints.

It is an even further objective of this invention to provide a handle for a tool that accommodates the laterality of human performance.

It is yet a further objective of this invention to establish a better aligned, two-handed usage.

It is a still further objective of this invention to make a tool handle whose tail section does not interfere with, or protrude awkwardly into the torso.

It is an even further objective of this invention to provide a handle for a tool that improves visibility of tool head.

It is a still further objective of this invention to provide a handle that allows for a variety gripping postures.

It is still another objective of this invention to provide a handle having these and other advantages in a configuration that is competitive in price, and attractive in appearance.

These an other advantages of Applicant's invention will be apparent from a review of the drawings wherein:

LIST OF FIGURES

DRAWING REFERENCE NUMERALS

16 tool head/scraper tool

18 tool shaft/neck elongated member

21 locus point of connection of tool shaft and gripping portion

22 two-membered gripping portion of handle

24 first or front elongated member of gripping portion/-dominant hand grip

Figure 10:
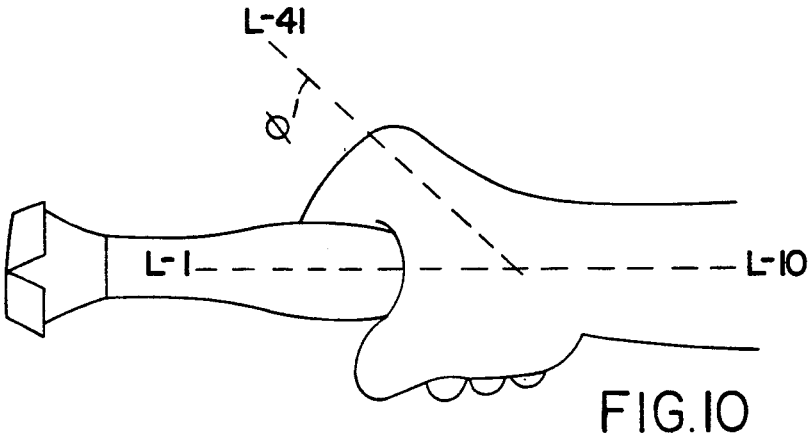
FIG. 10 shows the Bennett, 77 hammer from a top view.
Figure 11:
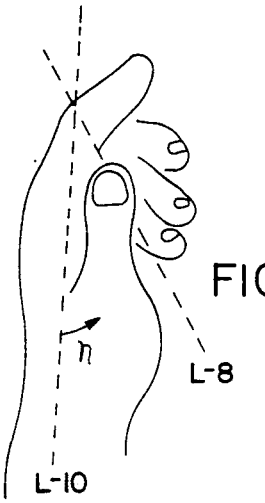
FIG. 11 shows pointing hand posture from side view.
Figure 12:
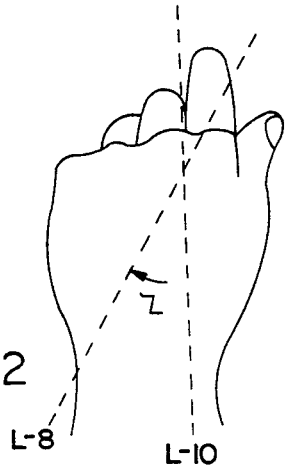
FIG. 12 shows pointing hand posture from top view.
Figure 13:
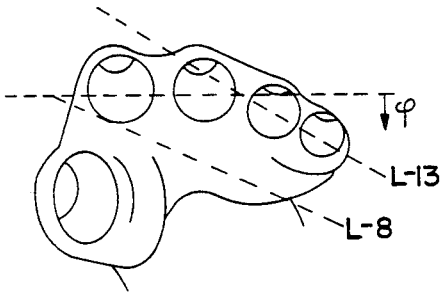
FIG. 13 shows pointing hand posture from endview.
Figure 14:
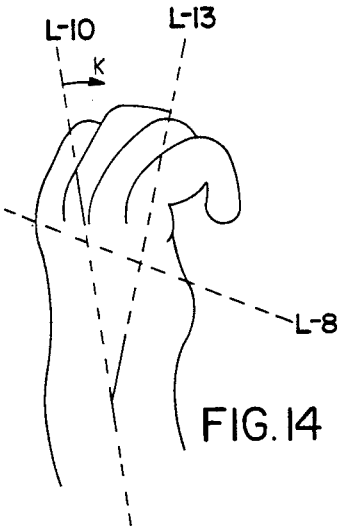
FIG. 14 shows gripping hand posture from outer edge, side view.

25 locus point of connection of first and second members of gripping portion 26 second or rear elongated member of gripping portion/supporting hand grip
30 first cushion grip/grip of front elongated member of gripping portion
32 second cushion grip/grip of rear elongated member of gripping portion
40 area of closure on palm of hand, at base of two little fingers/clasping zone
41 area of closure on palm of hand, at base of thumb
42 area of closure on palm of hand, at base of fore fingers/pointing zone
43 heel of palm/pushing zone
L-1 longitudinal axis line of tool shaft-neck elongated member of tool head
L-2 longitudinal axis line of first member of gripping portion
L-3 longitudinal axis line of second member of gripping portion
L-4 longitudinal axis line of two-membered gripping portion
L-5 cross-sectional major axis line of first cushion grip
L-6 cross-sectional major axis line of second cushion grip
L-7 line of sight from user's eye to target work area
L-8 axis of closed grip of dominant hand
L-9 axis of closed grip of supporting hand
L-10 longitudinal axis line of forearm of dominant side of user
L-11 longitudinal axis line of forearm of supporting side of user
L-13 longitudinal axis line of palm of hand
L-20 longitudinal axis of Bennett, 77 grip
L-30 longitudinal axis of Hughes, 81 grip
L-41 longitudinal axis of palm of hand, gripping Bennett, 77 grip
$\alpha$ neck angle between tool shaft-neck and two-membered gripping portion
$\beta$ crank angle between tool shaft-neck and first member of gripping portion
$\chi$ crank angle between tool shaft-neck and second member of gripping portion
$\delta$ rotation angle of major axis of cross-section of ovate cushion grip
$\epsilon$ grip angle between tool shaft-neck and gripping portion of Bennett, 77
$\phi$ deviation angle of wrist in FIG. 10
$\gamma$ neck angle of Hughes, 81
$\eta$ flexion angle of wrist in FIG. 11
$\iota$ offset angle across palm in FIG. 12
$\Phi$ rotation angle of wrist in FIG. 13
$\kappa$ rotation angle of wrist in FIG. 14
$\mu$ angle between first and second members of gripping portion A more detailed understanding of the invention can be obtained by referring to the accompanying drawings.

The handle of this invention, embodied in an otherwise conventional scraper, is illustrated in FIGS. 1 through 7.

The size of the tool shaft/neck elongated member 18 and the elongated members (24 and 26) of the two-membered gripping portion 22 may vary greatly from application to application. However, for a typical embodiment for a scraper/tool head 16, the diameter of the elongated members may be of a uniform diameter of approximately 0.75 inches. The length of the neck elongated member 18, connecting the scraper/tool head 16 with the two-membered gripping portion 22 of this invention, will typically be 4 inches. The length of the first elongated member 24 of the two-membered gripping portion 22 will be enough to allow control by the dominant hand. For the typical scraper embodiment, this length will be approximately 5 inches. The length of the second elongated member 26 of the two-membered gripping portion 22 will be enough to allow control by the supporting hand. For the typical scraper embodiment, this length will be 5 inches.

The ovate, cushioning grip is approximately hand sized, or 4 inches in length and 4.5 inches in circumference. The cushion grips 30 and 32 are positioned along the lengths of each member 24 and 26 respectively.

Figure 2:
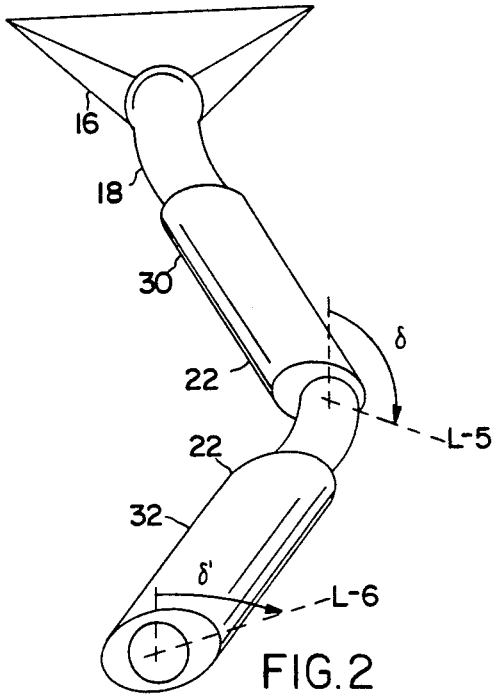
FIG. 2 is an end view of the scraper.
Figure 3:
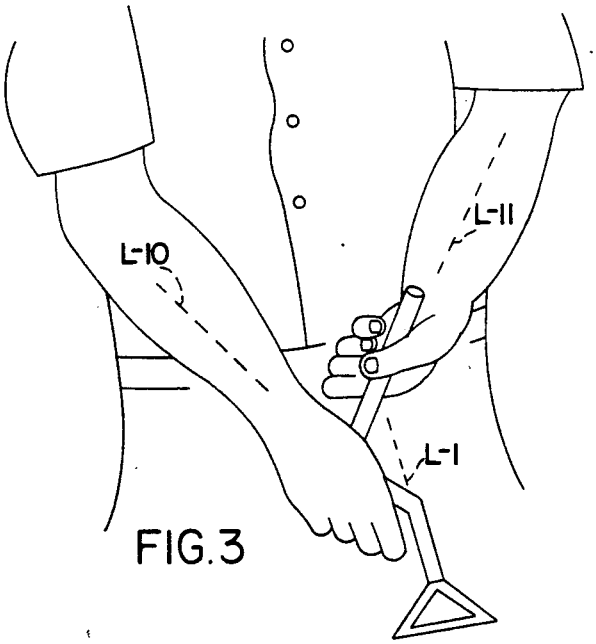
FIG. 3 is a scraper in use from front view.
Figure 4:
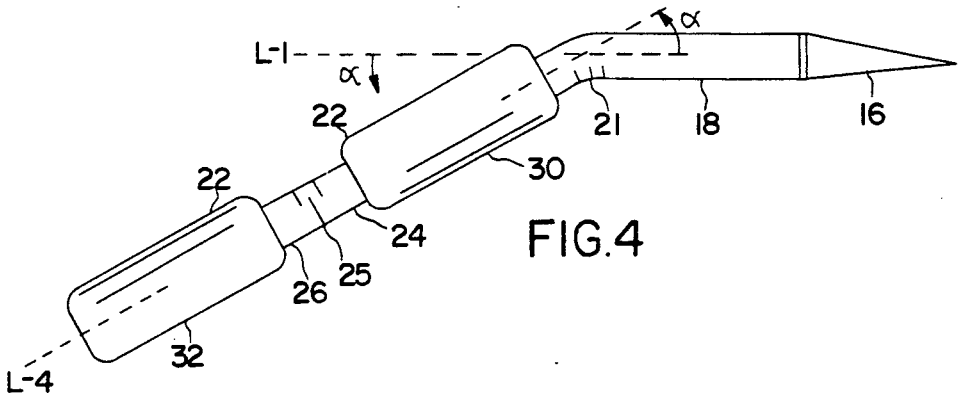
FIG. 4 is a side view of the scraper.
Figure 6:
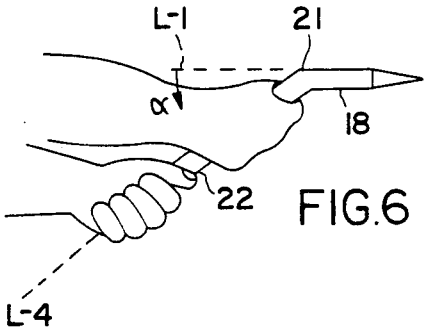
FIG. 6 is a scraper in use from a right side view.
Figure 7:
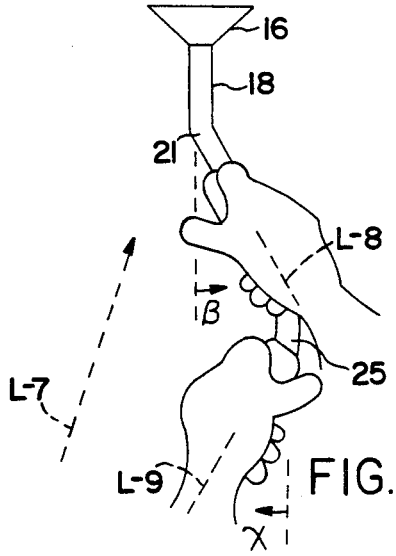
FIG. 7 is a scraper in use from top view.

As shown in FIGS. 2 and 4, applicant's handle has a two-membered gripping portion 22, angularly disposed from the neck elongated member 18 of the handle, whereby the gripping portion 22 is substantially coaxial with the tool handle when a scraper 16, or similar implement, is used in the conventional manner, as shown in FIGS. 3, 6, and 7.

Figure 1:
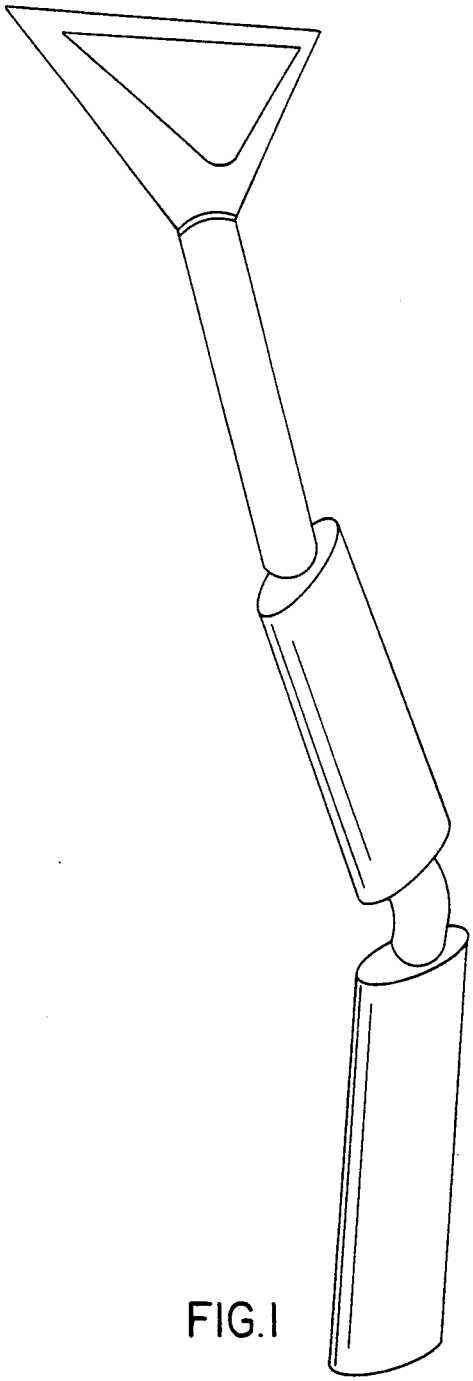
FIG. 1 is a longitudinal perspective of a wallpaper scraper embodiment.

FIG. 1, a longitudinal perspective, shows a general view of the handle as applied to a scraper.

FIG. 4, a side view, shows the longitudinal axis L-4 of the two-membered gripping portion 22 is angularly disposed downward approximately 30 degrees (as neck angle $\alpha$) from the axis line L-1 of the tool shaft-neck elongated member 18 at locus 21. Axis L-1 defines a first horizontal reference plane and first vertical reference plane of the handle.

Figure 5:
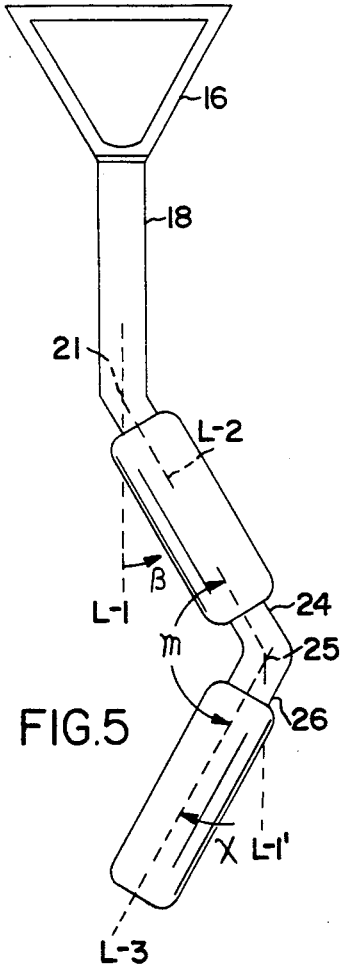
FIG. 5 is a top view of scraper.

FIG. 5, a top view, shows the longitudinal axis L-2 of the first elongated member 24 of two-membered gripping portion 22, is angularly disposed outward approximately 30 degrees (as crank angle $\beta$) at locus 21. Axis L-2 defines a second vertical reference plane of the handle.

The longitudinal axis L-3 of the second elongated member 26 of two-membered gripping portion 22, which defines a third vertical reference plane of the handle, is angularly disposed inward approximately 30 degrees (as crank angle $\chi$) at locus 25, the axes of L-2 and L-3 thereby forming a resultant angle of 120 degrees (as angle $\mu$).

FIG. 2, an end view, shows the first cushion grip 30 is positioned over the mid-section of the first elongated member 24. The second cushion grip 32 is positioned over the mid-section of the second elongated member 26. The vertical cross-sectional axis L-5 of the ovate cushion grip 30 is angularly disposed forward, as rotation angle $\delta$. The vertical cross-sectional axis L-6 of the ovate cushion grip 32 is angularly disposed forward, as rotation angle $\delta'$.

FIG. 6 shows the use of the downward angular disposition (as neck angle $\alpha$) of the longitudinal axis L-4 of the two-membered gripping portion 22 of the handle of this invention. The axis L-4 defines a second horizontal reference plane of the handle.

FIG. 3 illustrates that the offsetting, sideways angular dispositions (as crank angles $\beta$ and $\chi$) of the elongated members 24 and 26 of the gripping portion of the handle aligns their respective axes (L-2 and L-3) with the natural grip lines (L-8 and L-9) of the users hands. This displacement further aligns the axis L-1) of the tool shaft-neck 18 with axes of the forearms (L-10 and L-11).

FIG. 7 shows, the first member 24 of the two-membered gripping portion 22 is substantially coaxial with the longitudinal axis L-8 of the closed grip of the dominant hand. The second member 26 of the two-membered gripping portion 22 is substantially coaxial with the longitudinal axis L-9 of the closed grip of the supporting hand. The resulting combined effect is that the user can maintain a relaxed, safe, and strong, pointing grip with both hands, while manipulating the tool head. Another consequence of this compound angle, offset to the two-membered gripping portion 22 of the handle of this invention, is the improved visibility of the tool head. at the opposite end of the tool shaft, due to the displacement of the hands out of the line of sight L-7 between the user's eyes and the work target, here the tool head 16. This unobstructed view can be a notable benefit for tool applications involving shorter handle extensions, such as knives, art brushes, chisels, trowels, etc.

Figure 8:
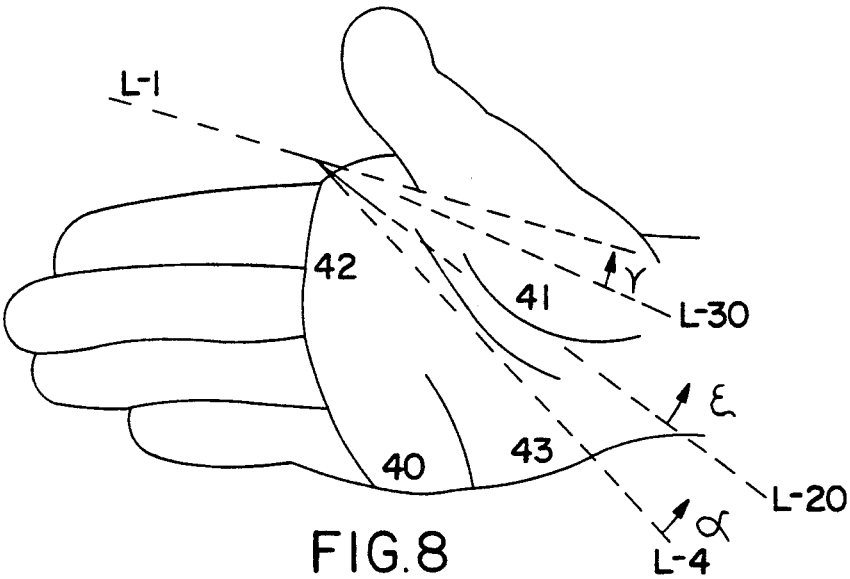
FIG. 8 shows the axis lines of the grips on the open palm.

FIG. 8 shows, the open palm of the hand, marked with grip axis lines and areas of closure. In Hughes,81, a 7 degree grip angle, along axis line L-30, for the upper portion of the handle is indicated as angle ($\gamma$). In Bennett,77, an ergonomic grip specifies a grip axis L-20, angularly disposed approximately 19 degrees ($\epsilon$) to the longitudinal axis L-1 of the neck elongated member 18. The longitudinal axis L-4 of the two-membered gripping portion 22 of this invention, is specified as an angle ($\alpha$) of approximately 30 degrees to the longitudinal axis L-1 of the neck elongated member 18.

FIG. 8 demonstrates the impact of relatively minor deviations of grip axes on the gripping, or closing, dynamics of the hand itself. The small angle $\gamma$ of Hughes,81 has no significant correspondence with the grip closure axes of the hand. The angle $\epsilon$ of Bennett,77, will allow some of the comfort of joint alignment. And, a larger angle $\alpha$ is specified in this invention. This larger grip angle $\alpha$ disposes the grip axis L-4 closer to the area of closure 40 at the base of the little fingers, while fully intersecting the heel of palm 43. This change accommodates the clasping action of the hand, providing a significant measure of additional control to the user. This difference ensures a more secure grasp by the two smaller fingers, while allowing freedom of movement around the base of thumb 41, and sufficient contact with the base of the forefingers 42. Furthermore, the intersection of the heel of the palm 43 by the handle provides substantial support for the hand and, through proximity, for the wrist.

Figure 9:
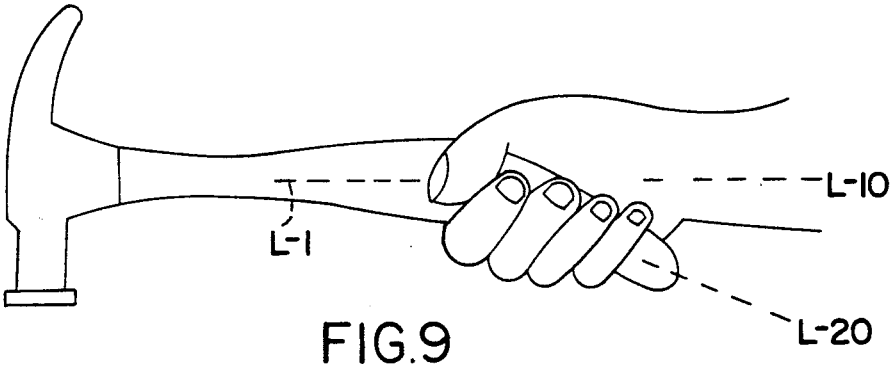
FIG. 9 shows the Bennett, 77 hammer from a side view.

FIGS. 9 and 10 illustrate the same hand grip posture, from two perspectives, a side view FIG. 9 and a top view FIG. 10. From a side view (see FIG. 9), the wrist may be substantially straight, aligned along the longitudinal axis L-10 of tool handle and forearm. But, from a top view of the same grip posture (see FIG. 10.), the longitudinal axis L-41 of the palm clearly deviates as angle $\phi$ from the axis of the tool and forearm L-10.

FIGS. 11, 12, and 13 illustrate a pointing hand posture, with grip axis lines, from side, top, and end view perspectives. When the hand and forearm are aligned in a straight, pointing posture, along the coaxial forearm and tool handle axis L-10, the axis line of the palm grip L-8 is angularly disposed downward, as an angle $\eta$, (see FIG. 11) for the primary gripping plane, and, outward, at an angle $\iota$ toward the outer edge of the hand 43 (see FIG. 12).

FIG. 13 illustrates an end view, cross-sectional perspective of the pointing hand. The grip palm axis L-8 is angularly disposed from horizontal at angle $\Phi$ downward, along the outer edge of the palm. The grip axis L-8 approaches the area of closure for the smaller two fingers 40, allowing a secure grasp, and, intersects the heel of the hand 43, which, by its proximity to the end of the ulna, provides additional support to the forearm.

The heel of the hand's palm area 43 provides the predominant locus of control for pressing, pushing, lifting, and other actions requiring direct transfer of forces from the forearm into the tool handle. In an open, pressing posture, the plane of this area is almost horizontal. In a pointing posture, with the knuckle of the index finger in an uppermost or vertical position, the palm of the hand is rotated outward, outer edge downward, moving the forearm's ulna directly below the radius bone. This hand posture minimizes angular deviations of the hand from the forearm axis. The offsetting angular dispositions of the handle of this invention minimize wrist bending, as seen in FIG. 10, while preserving flexibility of the hand about the wrist.

FIG. 14 shows the outside edge of the gripping hand and forearm. During grip closure, there is a downward bend of the outer sector 40 and 43 of the palm, as the fingers rotate around the handle, moving into the grasping position. This motion is indicated in FIG. 13 as angle $\Phi$. Also, this displacement is further indicated in FIG. 14 by the angle $\kappa$ between the grip axis line L-8, along the longitudinal axis L-10 of the forearm and hand.

Figure 15:
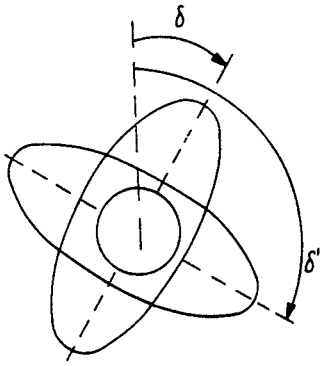
FIG. 15 shows an ovate cross-section cushion grip with rotation angles.

FIG. 15 shows a closer view of the rotated, ovate cushion grip 30, from an end perspective. The major axis line of the cushion grip cross-section is indicated as L-5. The rotation angles of the cushion grip 30 are indicated as angles $\delta$ and $\delta'$.

To better align a conforming plane of a cushion grip with the pushing zone 43 of the palm of the hand in the above-described posture, a forward rotation angle, corresponding approximately to angles $\Phi$ and $\kappa$, is specified for the larger, flat plane of the ovate cushioning grip. As seen from the outside edge of the hand and forearm, the major axis L-5 of the cushion grip cross-section is rotated forward, toward the implement, from a vertical originating position, to accommodate the downward movement of the palm, as illustrated in FIGS. 13 and 14. From other perspectives, the direction of this rotation would be described more accurately, relative to the dominant or supporting hand sides of the user.

For rotation angle $\delta$, the wider surface, along the major axis L-5, of the ovate cross-section corresponds to the heel of the palm 43 to provide full controlling support and maximum force transfer for the palm. For applications of the handle to tools emphasizing downward pressure motions, such as the wallpaper scraper embodiment in FIG. 1, the rotation angle $\delta$, herein specified as 30 degrees downward from horizontal, is recommended.

For rotation angle $\delta'$, the wider surface, along the major axis L-6, corresponds to the area at the base of the two forefingers 42 to facilitate full closure of the fingers about the handle. For applications of the handle to tools emphasizing controlled, swinging motions, the rotation angle $\delta'$, herein specified as 30 degrees outward from vertical, is recommended.

Both conformations indicated by rotation angles $\delta$ and $\delta'$ allow a straight wrist posture, though different hand gripping styles. For the sake of uniformity, both rotation angles will be described relative to the vertical origin. The wider, horizontal disposition of the preferred embodiment scraper is 30 degrees (from horizontal) plus an additional 90 degrees (which reflects the rotation to the minor axis of the cushion grip cross-section), or 120 degrees from vertical. Thus, rotation angles δ and δ' are, respectively, 120 degrees and 30 degrees from vertical.

Another significant consequence of this compound angle, offset to the two-membered gripping portion 22, of the handle of this invention, is the inclusion of laterality, or the accommodation of user handed-ness, into the design. The elongated member 24, described as the first part of the two-membered gripping portion 22, is meant to be held primarily by the dominant hand of the user, and, can correspond to either the right or left hands of the user. The elongated member 26, described as the second part of the two-membered gripping portion 22, is meant to be held primarily by the weaker, supporting hand of the user, and, can similarly correspond to either the right or left hand of the user.

FIG. 3 illustrates, the relative positions of the two-handed gripping posture, for a right-handed model. The dominant hand is closest to the neck elongated member 18 and implement, to allow maximum control, while the supporting hand is behind and slightly lower. The second, supporting hand extends naturally to the region of the wrist of the dominant hand. The second elongated member 26 is, accordingly, set back further from the tool shaft/neck elongated member 18, after the first elongated member 24. This configuration allows a coaxial alignment of the right and left hands individually, with each respective member of the two-membered gripping portion 22.

FIG. 7 illustrates, a right-handed model of scraper, held by a right-handed user. A tool handle in which the elongated member 24 bends outward toward the right side of the user, while the elongated member 26, bends inward toward the left side of the user, is called a right-handed model. A right-handed user would, typically, hold elongated member 24 with the dominant, right hand while supporting elongated member 26 in the left hand.

Figure 16:
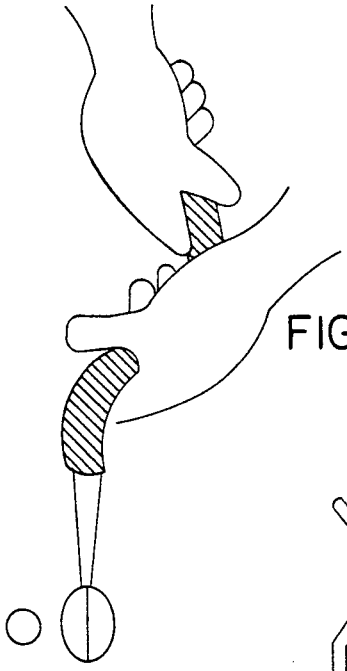
FIG. 16 is a top view of a left-handed golf club in use.

FIG. 16 illustrates a left-handed model of a golf club, held by a left-handed user. A tool handle in which the elongated member 24, bends outward toward the left side of the user, while the elongated member 26, bends inward toward the right side of the user, is called a left-handed model. A left-handed user would, most often, hold elongated member 24 with the dominant, left hand, while supporting elongated member 26, in the right hand. For work activities which require strength and coordination, such as swinging a golf club or an axe, the enhancement of control afforded by such an accommodation to handed-ness is substantial. Also, while the dominant hand may easily override discomforts of unnecessary joint flexions, the supporting hand often needs the added advantage of an aligned grip. Thus, in a dual-handed activity, the supporting hand is able to contribute significantly more to the work.

The illustrations FIGS. 3, 6, 7, and 16 show, that the described pointing postures are maintained for both hands. Clearly, the handle of this invention may be held with a either hand alone, or both hands in combination. Therefore, the user may shift gripping postures during use easily and effectively to reduce fatigue and at least some of the additive effects of stress. One of the best ways to minimize such injury is to hold a tool with a variety of postures, thereby distributing stress over a wider area of the body, and at a lesser rate of exposure for any specific body part. While the angular dispositions specified in this invention are referred back to a single pointing posture, this particular configuration, paradoxically, is appropriate to a range of gripping postures, as seen in the drawings.

Figure 17:
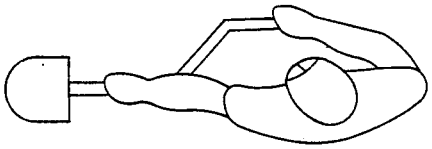
FIG. 17 is a top view of a shovel on the supporting hand side of the user.

FIG. 17 illustrates, the tool placed toward the opposite or supporting hand side. Here, the torso can be closer to the axis of the tool handle because it can move into the recess formed by the angle of the two parts of the gripping portion. This closer position allows the torso to apply force along the full length of the gripping portion, and adds to the feeling of control on what would normally be the weaker side of the user.

Figure 18:
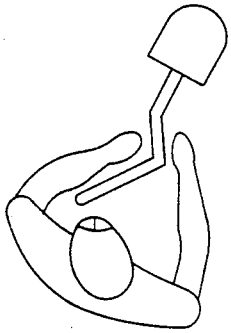
FIG. 18 is a top view of a shovel directly in front.

FIG. 18 illustrates, the tool placed at the center of the torso, directly in front of the user. The tail section 26 is low toward the center of mass of the torso, while the arms are generally straight. This encourages the coordinated use of the whole body, as opposed to localized muscular effort by the arms.

Figure 19:
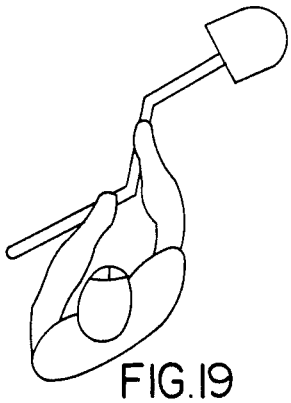
FIG. 19 is a top view of a shovel on the dominant hand side.

FIG. 19 illustrates, the tool placed to work at a spot directly in front of the dominant hand (here, the right-hand model). The tail section 26 is near parallel with the frontal plane of the torso. This alignment allows the work-saving transfer of body weight into the handle along this section.

When compared with a straight tool handle of the same length, the gripping portion of the handle of this invention, is less likely to intrude into the torso, or interfere with the movement of the arms. This arrangement permits the user to manipulate the tool shaft and tool head, for a full range of movements. Throughout this range, the relatively straight alignment of forearm and tool shaft, as well as an relatively erect torso, can be maintained.

Figure 20:
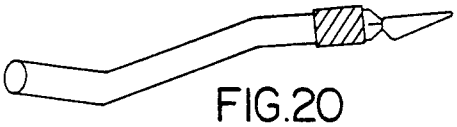
FIG. 20 shows a utility razor.
Figure 21:
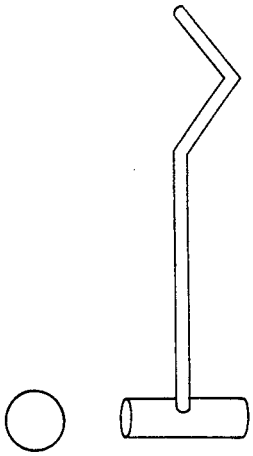
FIG. 21 shows a left-handed croquet mallet.
Figure 22:
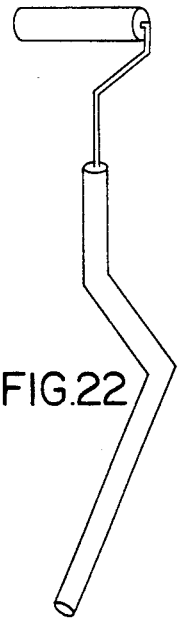
FIG. 22 shows a paint roller.
Figure 23:
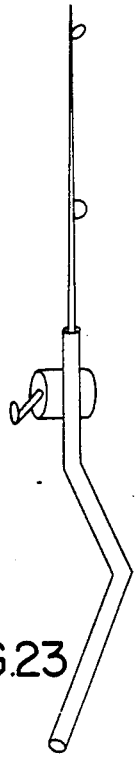
FIG. 23 shows a fishing rod.

FIGS. 20, 21, 22, and 23 illustrate, the handle of this invention applied to several tools of varying sizes. FIG. 20 shows a razor knife. FIG. 21 shows a left-handed croquet mallet. FIG. 22 shows a paint roller. FIG. 23 shows a fishing rod.

The handle of this invention can be applied on numerous tools or sporting equipment. The elongated member may be the conventional handle used on tools such as brushes, hammers, garden tools, or the like. And, the elongated member may be the conventional handle used on conventional sporting equipment such as a golf club, fishing rod, ball bat, etc.

SUMMATION

It is observed that the handle of this invention provides a less stressful interaction between tool and user applying pushing, pulling, lifting, or swinging forces. This handle design can reduce fatigue and lessen the risk of injury, by allowing more consistently balanced and coordinated alignment of the whole body posture. Also, work performance can be enhanced by increased tool visibility, and accommodations for handed-ness as well as dual-handed usage. Furthermore, cumulative stress injuries may be lessened by the availability of gripping posture variation afforded by this novel design.

The neck elongated member 18 may be made of plastic, metal, or wood; it may be solid or hollow., and vary substantially in relative sizes and shapes.

The two-membered gripping portion 22 may be an extension of the basic material of the elongated member 18, or a customized, separate attachment thereof.

A latitude of modification, change and substitution is intended in the foregoing disclosure. Accordingly, it is appropriate that the appended claims be construed broadly and in the manner consistent with the spirit and scope of the invention.

What is claimed is:

1. A handle of an implement selected from the groups of tools and sporting equipment, said handle for reducing excessive wrist-bending of user, thereby increasing control and comfort while manipulating the implement toward an intended target, said handle comprising: a neck elongated member connected to said implement at a neck first end; and an integrally abutting two-part gripping portion connected to said neck at a neck second end, comprising a front elongated member adjacent said neck second end, a rear elongated member integrally abutting said front elongated member at free end;

wherein the longitudinal axes of said neck and said implement define a first horizontal reference plane and a first vertical reference plane, said two-part gripping portion is disposed in a second horizontal reference plane, said second horizontal plane being angularly disposed from said first horizontal plane, the longitudinal axis of said front elongated member defining a second vertical reference plane, and the longitudinal axis of said rear elongated member defining a third vertical reference plane, while both said front elongated member and said rear elongated member are disposed in said second horizontal reference plane, said second vertical reference plane is angularly disposed from said first vertical reference plane, and said third vertical reference plane is angularly disposed from said second vertical reference plane, whereby when said gripping portion is placed in the hands of user for manipulation of said implement, the longitudinal axes of said front and rear elongated members are substantially coaxial to the longitudinal axes of the forearms of user, simultaneous rotation of the hands about the longitudinal axes of forearms of user causes substantially coaxial rotation of said implement about the longitudinal axis of said neck.

2. A handle as in claim 1, wherein said second horizontal reference plane diverges downwardly from said first horizontal reference plane at an angle $\alpha$, $25° \leqq \alpha \leqq 35°$;

said second vertical reference plane diverges from said first vertical reference plane at an angle $\beta$, $25° \leqq \beta \leqq 35°$;

and said third vertical reference plane diverges from said second vertical reference plane at an angle $\mu$, $115° \leqq \mu \leqq 125°$.

3. A handle as in claim 2, further comprising Cushion grips surrounding at least one of said members of said two-part gripping portion, said Cushion grips each comprising:

an elongated tubular member of resilient material, having a substantially ovate cross-section, including major and minor axes, said tubular member being substantially coaxial with the longitudinal axis of said member it surrounds and firmly engaged to said member;

wherein said major axis of said cushion grip cross-section is angularly disposed by a rotation angle about the longitudinal axis of said member.

4. A handle as in claim 3, wherein said cushion grip surrounds at least a portion of said front elongated member, said rotation angle of said major axis being between 115 and 125 degrees.

5. A handle as in claim 3, wherein said cushion grip surrounds at least a portion of said rear elongated member, said rotation angle of said major axis being between 55 and 65 degrees.

6. A handle as in claim 3, wherein said cushion grip surrounds at least a portion of said front elongated member, said rotation angle of said major axis being between 25 and 35 degrees.

7. A handle as in claim 3, wherein said cushion grip surrounds at least a portion of said rear elongated member, said rotation angle of said major axis being between 145 and 155 degrees.

* * * * *